US005329693A

United States Patent [19]

Smith

[11] Patent Number: 5,329,693

[45] Date of Patent: Jul. 19, 1994

[54] SEPARATION TOOL FOR MULTIPIN ELECTRICAL CONNECTORS

[75] Inventor: Larry D. Smith, Sylmar, Calif.

[73] Assignee: The United States of America as represented by the Administrator of the National Aeronautics and Space Administration, Washington, D.C.

[21] Appl. No.: 48,871

[22] Filed: Mar. 30, 1993

[51] Int. Cl.[5] ..... H01R 43/00

[52] U.S. Cl. ..... 29/764; 29/252; 439/158

[58] Field of Search ..... 29/762, 764, 233, 252; 439/158, 159, 160

[56] References Cited

U.S. PATENT DOCUMENTS

| | | | |
|---|---|---|---|
| 1,581,057 | 4/1926 | Hill | 29/252 |
| 3,081,066 | 3/1963 | Murawski | 29/239 X |
| 3,112,672 | 12/1963 | Webb | 439/158 X |
| 3,267,565 | 8/1966 | Stuhler | 439/160 X |
| 3,443,297 | 5/1969 | Lusby, Jr. | 29/764 |
| 3,451,119 | 6/1969 | Coberly et al. | 29/252 X |
| 3,516,142 | 6/1970 | De Rose . | |
| 3,579,795 | 5/1971 | Burman | 29/252 |
| 3,785,033 | 1/1974 | Lynch | 29/764 |
| 3,908,258 | 9/1975 | Barty | 29/252 |
| 3,909,899 | 10/1975 | Witt | 29/764 |
| 3,990,863 | 11/1976 | Palmer . | |
| 4,240,191 | 12/1980 | Schroyer | 29/252 X |
| 4,288,915 | 9/1981 | Bell | 29/762 |
| 4,389,912 | 6/1983 | Dallons et al. | 29/764 X |
| 4,429,857 | 2/1984 | Ferguson | 29/252 X |
| 4,521,959 | 6/1985 | Sprenkle | 29/764 X |
| 4,583,287 | 4/1986 | McDevitt et al. | 29/764 X |
| 4,586,252 | 5/1986 | Faticanti | 29/762 |
| 4,620,366 | 11/1986 | Koon | 29/262 |
| 4,660,281 | 4/1987 | Omand | 29/764 |
| 4,870,739 | 10/1989 | Richards | 29/252 |
| 5,036,573 | 8/1991 | Congdon | 29/252 |
| 5,050,285 | 9/1991 | Wrage | 29/252 |

*Primary Examiner*—Z. R. Bilinsky

*Attorney, Agent, or Firm*—John H. Kusmiss; Thomas H. Jones; Guy M. Miller

[57] ABSTRACT

A hydraulic tool for safely separating one multipin electrical connector from another. The preferred separation tool consists of a master cylinder which operates a pair of slave cylinders, each slave cylinder having a corresponding operative shaft and an extraction tab. The slave cylinders are variably spaced apart from one another such that they may be positioned on either side of mated connector pairs of different sizes and so that their extraction tabs may be slid between the connectors. When the master cylinder's plunger is operated, such operation is hydraulically transmitted to the operative shafts of the slave cylinders which extend outward and, once pressed against a substrate, causes the slave cylinders and corresponding extractor tabs to move away and separate one connector from the other. A second preferred separation tool includes an additional pair of extractor tabs, one at the end of each operative shaft, so that the tool can be used to separated a mated connector pair hanging in free space. The extractor tabs may be notched in order to be inserted between the connectors around mounting hardware used to secure the connectors to each other.

14 Claims, 4 Drawing Sheets

SEPARATION TOOL FOR MULTIPIN ELECTRICAL CONNECTORS

ORIGIN OF THE INVENTION

The invention described herein was made in the performance of work under a NASA contract, and is subject to the provisions of Public Law 96-517 (35 U.S.C. §202) in which the Contractor has elected not to retain title.

TECHNICAL FIELD

The present invention relates generally to devices for separating mated electronic connectors and, more specifically, to a hydraulically-operated device for separating one multipin electrical connector from another.

BACKGROUND ART

There are many known devices for extracting electronic components. However, none of the known devices are particularly well suited for separating mated multipin connectors of various sizes.

For example, there are numerous hand-held devices for removing an integrated circuit (IC) from a corresponding socket. ICs typically come in either dual-in-line pin (DIP) packages or in flat pack packages. Accordingly, the known hand-held removal devices are generally directed to one package type or the other.

Examples of hand-held extractors for DIP packages are set forth in U.S. Pat. Nos. 3,785,033 and 4,389,912. The foregoing patents disclose tweezer-like devices which grip the underside of the DIP package on opposite sides thereof so that a person may manually pull the DIP package up and away from the associated connector.

More complicated devices for extracting DIP packages are disclosed in U.S. Pat. Nos. 3,443,297, 3,579,795, and 3,990,863. Each of these patents discloses a bridge-like component that is braced against the substrate on either side of the DIP package and a jaw-like member that is located around the DIP package to pull it up and away.

Typical devices for the extraction of flat package ICs are disclosed in U.S. Pat. Nos. 3,516,142, 4,521,959, 4,583,287, and 4,660,281.

Although there are numerous devices designed to extract various integrated circuits, there are no known devices suitable for quickly, easily, and safely separating one multipin electrical connector from another. Electronic devices are often attached to other electronic devices by such electrical connectors. An example of such an electronic connector is the standard "RS-232" connector provided on the back of many computers. RS-232 connectors are provided with 25 pins. For some systems, such as flight hardware, the electrical connectors can have 50 pins or more.

The difficulty in separating one connector from another is directly related to the number of pins. Each pin connection typically results in two to three ounces of retention pressure. The connectors are easily damaged when removed by hand, because it is difficult to apply even pressure across the connector. When the connectors are removed by rocking or by insertion of a screwdriver or such, the connectors themselves are often damaged or the pins bent during the separation process.

None of the known extraction devices for ICs are designed for separating multipin connectors which, at the present time, may have anywhere from 9 to 50 pins.

STATEMENT OF THE INVENTION

It is therefore an object of the present invention to provide a separation tool for separating one electronic connector from another;

It is another object of the present invention to provide a separation tool that separates a mated connector pair through the application of even pressure so that the connectors are not damaged and the pins are not bent;

It is another object of the present invention to provide a separation tool that may be adjusted to separate electrical connectors of varying width, i.e., a separation tool that will operate with both 9-pin connectors and 50-pin connectors, and all connectors in between; and It is another object of the present invention to provide a separation tool for electrical connectors that overcomes the difficulties associated with interference with associated connector retaining mounts.

Accordingly, as disclosed in further detail herein, the present invention is comprised of a tool for separating an upper electronic connector from a lower electronic connector mounted to a substrate comprising:

a support member;

first and a second extractor tabs connected to opposites sides of said support member and extending inward toward one another whereby said extractor tabs may be placed between the upper and lower connectors;

first and second operative shafts connected to opposite side of said support member adjacent to said horizontal extractor tabs, each operative shaft extending downward toward the lower connector; and means for moving said operative shafts from an upper position to a lower position whereby the operative shafts press against the substrate, cause the extractor tabs to move upward, and thereby separate the upper connector from the lower connector.

BRIEF DESCRIPTION OF THE DRAWINGS

The just-summarized invention will now be described in detail in conjunction with the drawings of which.

DETAILED DESCRIPTION OF THE INVENTION

The following description is provided to enable any person skilled in the art of separation tools to make and use the invention and sets forth the best modes contemplated by the inventor of carrying out the invention. However, various modifications will remain readily apparent to those skilled in these arts, since the herein disclosure relates to the generic principles providing a hydraulically-operated, variable-width separation tool for use with multipin connectors.

Figure 1:
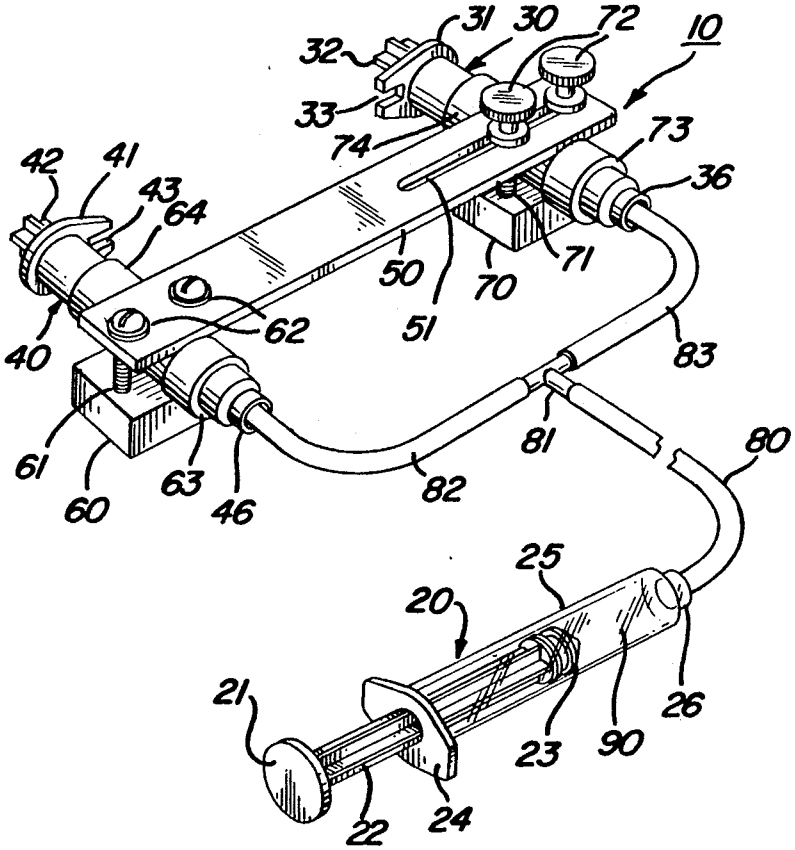
FIG. 1 is a perspective view of a first preferred separation tool according to the present invention.

FIG. 1 is a perspective view of a first preferred separation tool 10 comprised of a master cylinder 20 and a pair of slave cylinders 30, 40 having corresponding extractor tabs 31, 41. The master cylinder 20 and slave cylinders 30, 40 are preferably comprised of ordinary disposable syringes having, with reference only to the master cylinder 20, an outer barrel 25 in which a piston 23 is slidably housed. One side of the piston 23 is in fluid communication with a fluid coupling 26 located at a top end of the barrel 25, and the other side of the piston 23 is connected to a shaft 22, which extends towards and out a bottom end of the barrel 25. A pair of perpendicular finger flanges 24 are typically provided at the bottom end of the barrel 25 to accommodate the user's fingers. A thumb rest 21 is ordinarily provided to accommodate a user's thumb.

In the first preferred embodiment, the slave cylinders 30, 40 are also comprised of ordinary disposable syringes. However, these syringes are modified relative to the syringe which comprises the master cylinder 20. In particular, the slave cylinders' thumb rests (not shown) are removed to leave only operative shafts 32, 42, and the slave cylinders' finger flanges are modified to create the extractor tabs 31, 41. The extractor tabs 31, 41 are preferably provided with notches 33, 43, the purpose of which will be explained further herein.

FIG. 1 further shows that the first preferred separation tool 10 is comprised of an elongated support member 50 and means for connecting the slave cylinders 30, 40 to either end of the support member 50. The preferred connecting means are saddle-shaped connecting blocks 60, 70, each of which has a pair of threaded apertures on one side thereof. In FIG. 1, one such aperture 61, 71 is shown for each connecting block 60, 70, whereas the other aperture is hidden behind the respective slave cylinders 30, 40. A pair of screws 62, 72 is provided for each slave cylinder 30, 40, each pair of screws passing through an aperture in the support member 50 to a threaded aperture in the connecting blocks 60, 70 around either side of the corresponding slave cylinder 30, 40. The slave cylinders 30, 40 are preferably wrapped both above and below the support member 50 with layers of tape to form rings 63, 64; 73, 74. The connecting blocks 60, 70, the screws 62, 72, and the rings 63, 64; 73, 74 serve to secure the slave cylinders 30, 40 to the support member 50.

The first preferred separation tool 10 also includes means for varying the distance between the slave cylinders 30, 40 so that the extractor tabs 31, 41 may be used to separate various-sized connectors. As shown in FIG. 1, the preferred distance-varying means is an elongated slot 51 carried in and along the length of the support member 50 in combination with the screws 72 having knurled heads. An operator may easily loosen the screws 72 and then slide the slave cylinder 30 and associated connecting block 70 along the distance of the slot 51 as desired.

As further shown in FIG. 1, a plurality of tubes 80, 82, 83 and a T-fitting 81 are used to connect the fluid coupling 26 of the master cylinder 20 to fluid couplings 36, 46 of the slave cylinders 30, 40. In particular, the tube 80 is connected between the fluid coupling 26 and a first fluid coupling of the T-connector, and the tubes 82, 83 are respectively connected between the fluid couplings 36, 46 of the slave cylinders 30, 40 and the second and third fluid couplings of the T-connector 81.

With a fluid in the cylinders 20, 30, 40, the tubes 80, 82, 83, and the T-coupling 81, movement of the master cylinder's shaft 22 is hydraulically translated to movement of the slave cylinder's operative shafts 32, 42. Virtually any fluid will work. However, relatively incompressible fluids such as water are preferable to a relatively compressible fluid such as air so that the user is provided with tactile feedback concerning the amount of applied pressure.

Figure 2:
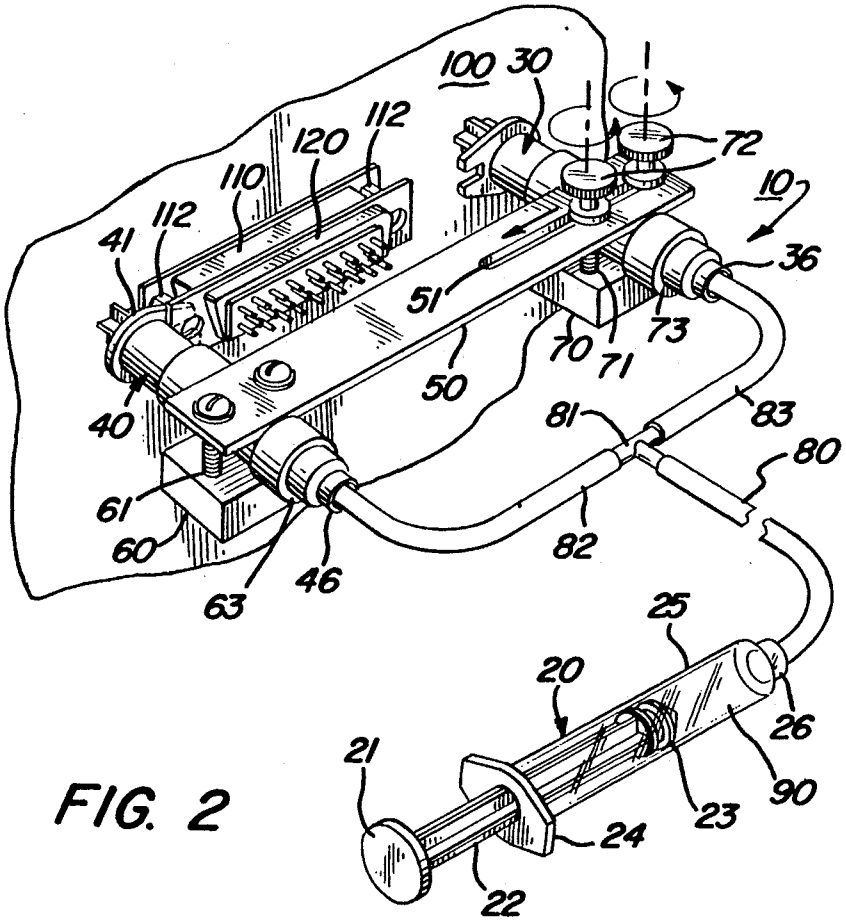
FIG. 2 is a perspective view of the first preferred separation tool showing it being adjusted to fit between a socket-type connector and a pin-type connector of a particular width, one of which is mounted to a substrate.
Figure 4:
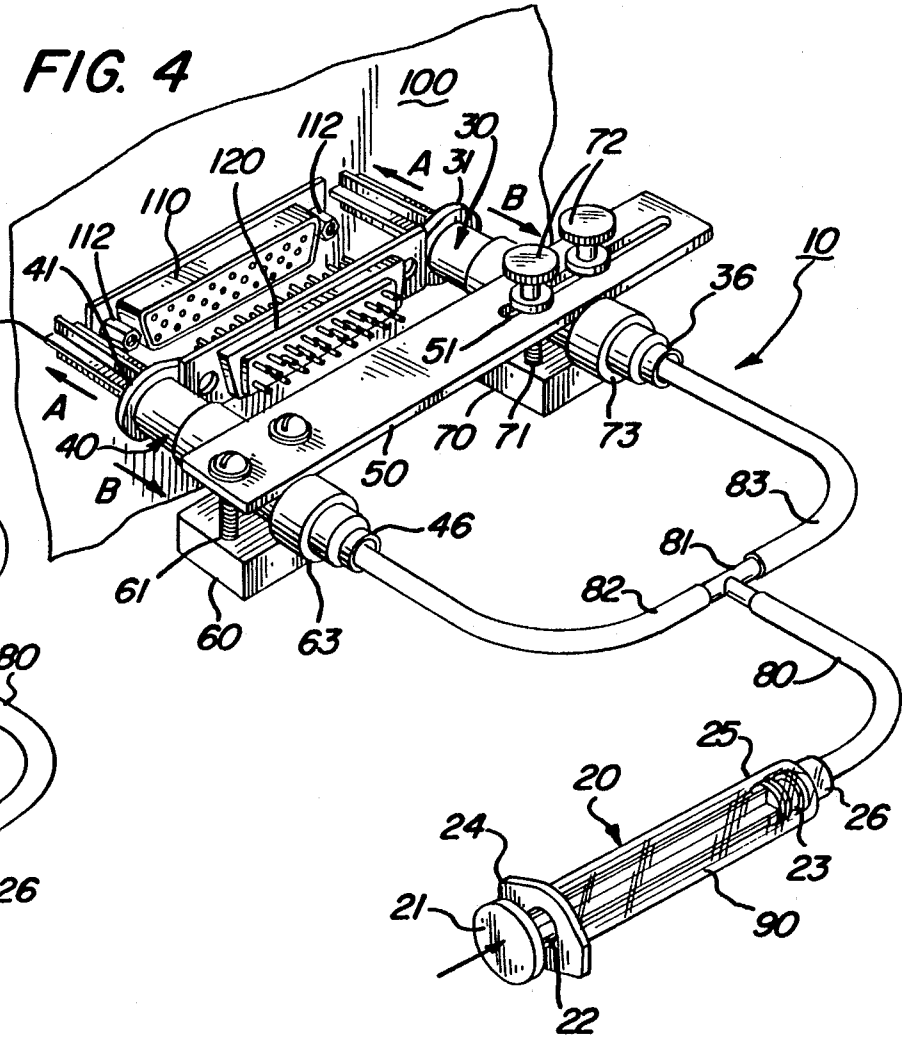
FIG. 4 is a perspective view of the first preferred separation tool suggesting its operation wherein depression of a master syringe's plunger results in two operative shafts pushing against the substrate, causing the extractor tabs to safely lift one mated connector away from the other connector.
Figure 3:
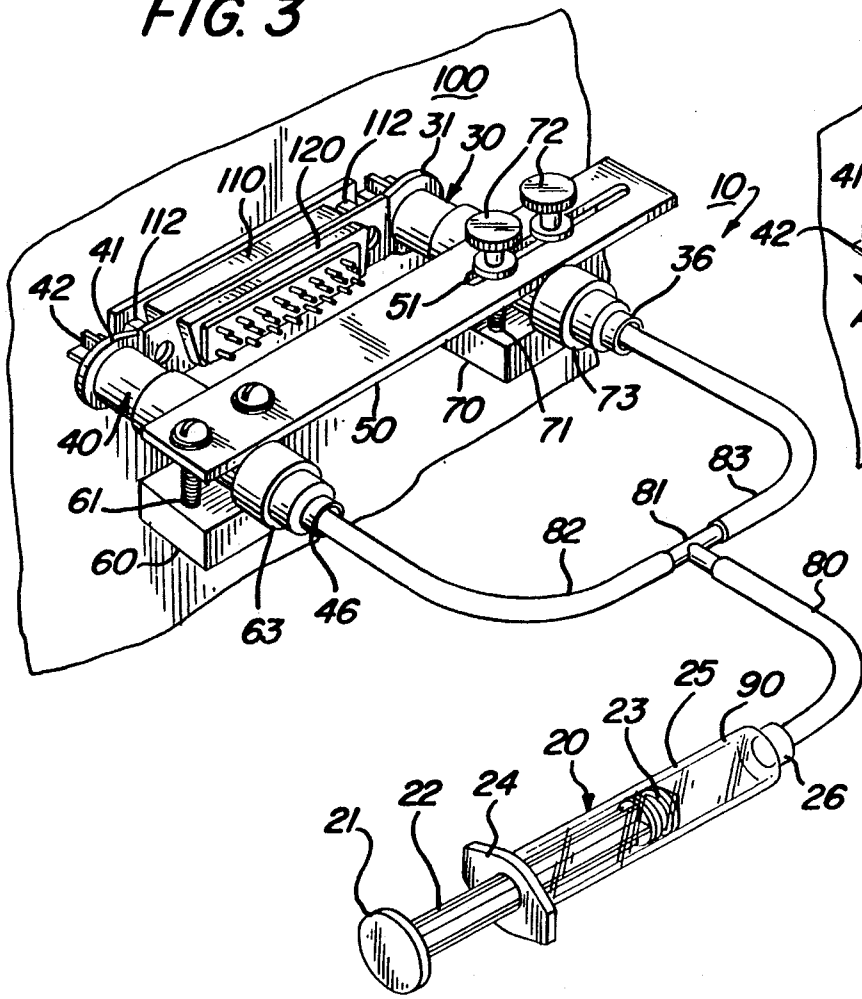
FIG. 3 is a perspective view of the first preferred separation tool with its extractor tabs inserted between the connectors.
Figure 5:
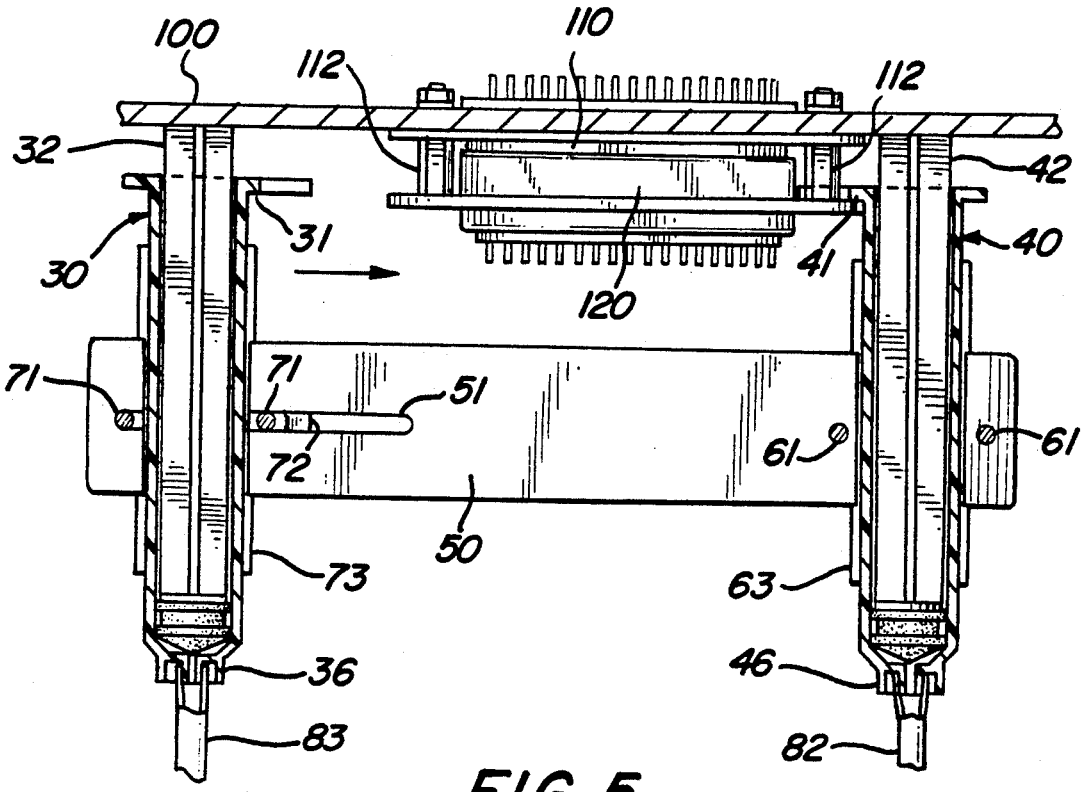
FIG. 5 is a cross-sectional view of the first preferred separation tool and the mated connectors to be separated in the state substantially as shown in FIG. 2.

The actual operation of the first preferred separation tool 10 is best understood with reference to FIGS. 2, 3, and 4, taken in that order. In FIG. 2, a socket-type connector 120 is shown connected to a pin-type connector 110, which is itself mounted to a substrate 100. For purposes of this description, the two mated connectors 110, 120 will sometimes be called simply "upper" and "lower" connectors, and the slave cylinders 30, 40 will be called "left" and "right" slave cylinders. To remove the upper connector 120 from the lower connector 110, the separation tool's left slave cylinder 40 is first positioned such that its extractor tab 41 is inserted between the mated connectors 110, 120. The extractor tab's notch 43 receives a connector mounting block 112 so that the extractor tab 41 can extend well between the connectors 110, 120. The knurled screws 72 are then rotated to loosen the connection between the support member 50 and the right slave cylinder 30 so that it may be slid towards the right side of the mated connector pair 110, 120, as suggested by the arrows in FIG. 2 and corresponding FIG. 5.

Then, as shown in FIG. 3, the right slave cylinder is positioned such that its extractor tab 31 is also inserted between the connectors 110, 120. Its notch 33 also receives a corresponding connector mounting block 112, thereby allowing the extractor tab 31 to fit further and more securely between the connectors 110, 120.

Figure 6:
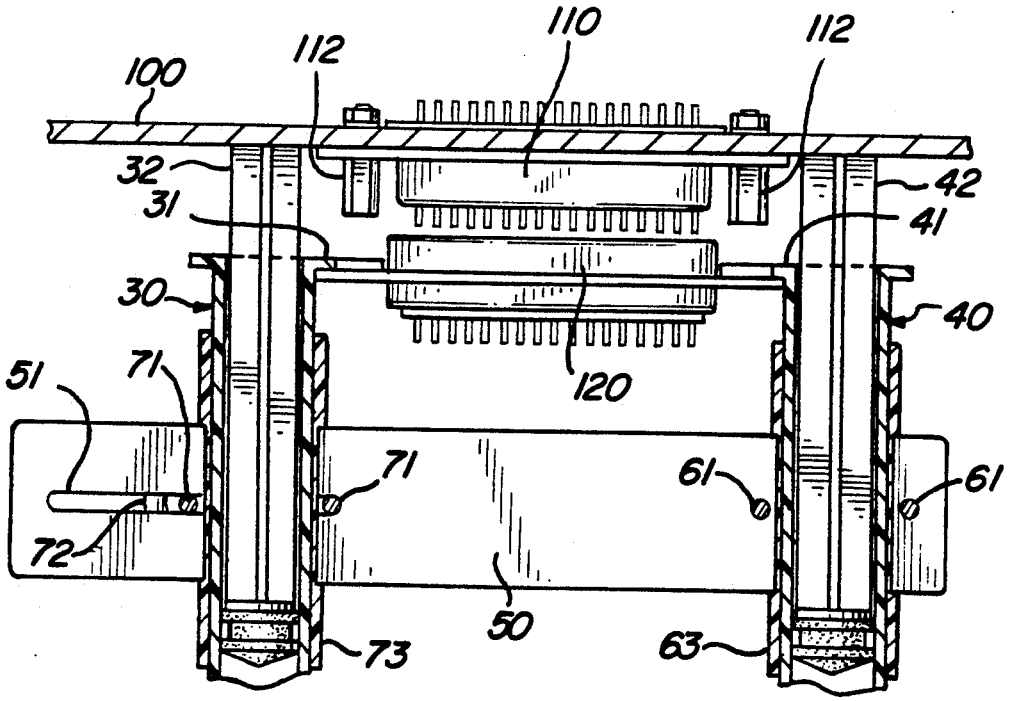
FIG. 6 is a perspective view of the first preferred separation tool with the socket-type connector separated from the pin-type connector substantially as shown in FIG. 4.

Once the extractor tabs 31, 41 are in place as shown in FIG. 3, the next step, as suggested by FIG. 4, is simply to depress the master cylinder's thumb rest 21 such that the operative shafts 32, 42 are extended away from the slave cylinders 30, 40 toward the substrate 100, as suggested by arrows "A." The user may desire to use his free hand, placing a thumb on one slave cylinder and a finger on the other, to help maintain even movement of the operative shafts 32, 42 and the extractor tabs 31, 41. Once the operative shafts 32, 42 come into contact with the substrate 100, then, as suggested by arrows "B," the hydraulics cause the slave cylinders 30, 40 themselves, and their associated extractor tabs 31, 41, to move away from the substrate 100, pulling the upper connector 120 smoothly and safely away from the lower connector 110, as shown in FIG. 6. The right slave cylinder 30 may now be slid along the slot 51, away from the left slave cylinder 40, to release the upper connector 120.

The separation tool 10 may be readied for another extraction operation by simply pressing the operative shafts 32, 42 by hand or against a flat surface such as a bench top, to force them back into the ready position in the slave cylinders 30, 40, and thereby hydraulically translating the master cylinder's piston 23 and shaft 22 back into the ready position.

Figure 7:
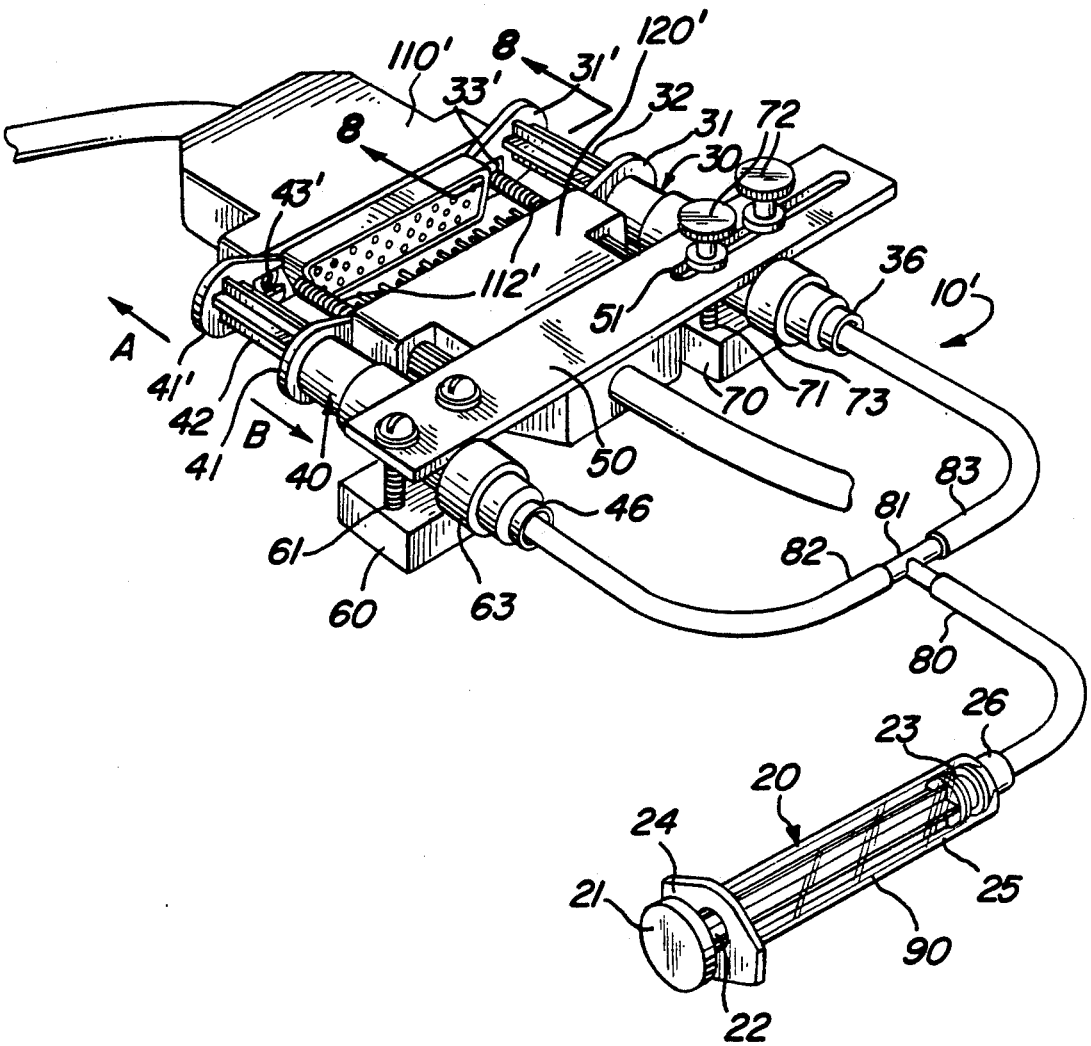
FIG. 7 is a perspective view of a second preferred separation tool wherein each of the operative shafts carries an extractor tab for use in separating a mated connector pair hanging in free space rather than mounted to a substrate as shown in FIG. 1.

FIG. 7 is a perspective view of a second preferred separation tool 10' for use in separating a mated pair of connectors 110', 120' that are connected to one another in free space rather than mounted to a substrate 100 as in FIG. 1.

The construction of the second preferred separation tool 10' is substantially the same as the first preferred tool 10 (FIG. 1) except for the inclusion of additional extractor tabs 31', 41' on respective ones of the operative shafts 32, 42. The additional extractor tabs 31', 41', like their extractor tab cousins 31, 41, include slots 33', 43' for accommodating connector mounting hardware, in this case screws 112', 112'.

Figure 8:
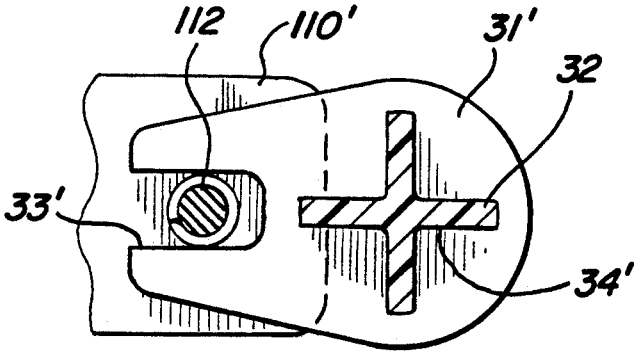
FIG. 8 is a cross-sectional view of the second preferred separation tool of FIG. 7 taken along section lines 8—8.

The additional extractor tabs 31', 41' may be mounted to the corresponding operative shaft 32, 43 in any number of ways. One method is shown in FIG. 8 wherein extractor tab 31' has an aperture 34' with an X-shaped profile that corresponds to the operative shaft 32. By this arrangement, the extractor tab 31' may receive the operative shaft and be secured thereto with a suitable adhesive. Various other means for securing the tab 31' to the operative shaft 32, such as pins, integral molding, etc., could be used. Moreover, the slave cylinders' thumb rests, which are removed for the first preferred tool 10 of FIG. 1, may instead be modified to form the additional extractor tabs 31', 41'.

The operation of the second preferred separation tool 10' is substantially like that of the first tool 10, the main difference being that the additional extractor tabs 31', 41' push directly against the connector 110' rather than against a substrate 100 on which the connector 110 is mounted. By this arrangement and operation, the separation tool 10' can be used to quickly and safely separate a pair of free-hanging connectors as suggested by the arrows in FIG. 7.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

I claim:

1. A tool for separating an upper electronic connector from a lower electronic connector comprising:

a support member;

first and second extractor tabs connected to opposites sides of said support member and extending inward toward one another, said extractor tabs each including a flat surface, said extractor tabs being oriented relative to said support member such that said flat surfaces are parallel to and facing said upper connector, whereby said extractor tabs may be placed between the upper and lower connectors;

first and second operative shafts connected to opposite sides of said support member adjacent to said extractor tabs, each operative shaft extending downward toward the lower connector; and means for moving said operative shafts from an upper position to a lower position whereby the operative shafts press against the lower connector hanging in free space or a substrate on which the lower connector is mounted, causing the extractor tabs to move upward with said flat surfaces making substantially uniform contact with said upper connector, and thereby separating the upper connector from the lower connector.

2. The tool of claim 1 further comprising means for varying the spacing between the first and second extractor tabs whereby the extractor tabs may be placed between the upper and lower connectors of different sizes.

3. The tool of claim 2 further comprising a notch in each of said first and second extractor tabs whereby said extractor tabs may fit between the upper and lower connectors and around first and second mounting blocks associated with said connectors, said first and second mounting blocks being accommodated by the notch in a corresponding one of said first and second extractor tabs.

4. The tool of claim 1 further comprising third and fourth extractor tabs mounted respectively at a distal end of the first and second operative shafts and extending inward towards one another, whereby the third and fourth extractor tabs may be placed between the upper and lower connectors along with the first and second extractor tabs.

5. The tool of claim 4 further comprising means for varying the spacing between the first, second, third, and fourth extractor tabs whereby the extractor tabs may be placed between the upper and lower connectors of different size.

6. The tool of claim 5 further comprising a notch in each of said first, second, third, and fourth extractor tabs whereby said extractor tabs may fit between the upper and lower connectors and around first and second mounting blocks associated with said connectors, said first and second mounting blocks being accommodated by the notch in a corresponding one of said first and second extractor tabs.

7. A hand-operated tool for separating an upper electronic connector from a lower electronic connector comprising:

first and second hydraulic assemblies, each having a fluid operated shaft extending from a bottom end thereof;

first and second extractor tabs extending perpendicularly from the bottom ends of said corresponding first and second hydraulic assemblies;

variable-distance connecting means for mechanically connecting said first and second hydraulic assemblies to one another with said corresponding extractor tabs facing one another; and a third user-controlled hydraulic assembly operatively connected to said first and second hydraulic assemblies to move the fluid operated shafts of said assemblies in and out relative to the bottom end thereof whereby the user may place said first and second extractor tabs between the upper and lower connectors, move the corresponding shafts out relative to the bottom ends of said first and second hydraulic assemblies to press against the lower connector or a substrate on which the lower connector is mounted, and thereby cause the corresponding extractor tabs to lift the upper connector away from the lower connector.

8. A tool for separating an upper electronic connector from a lower electronic connector comprising:

a support member having a left end and a right end;

a left and a right slave cylinder, each having a piston with one side of the piston in fluid communication with a fluid coupling located at a top end of the slave cylinder and another side of the piston connected to a shaft which extends towards and out of a bottom end of the slave cylinder;

a left and a right extractor tab extending perpendicularly away from each respective slave cylinder at the bottom end thereof;

means for connecting said left and right slave cylinders to respective ends of said support member such that the respective extractor tabs are pointing towards one another;

means for varying a distance between the left and right slave cylinders whereby said extractor tabs may be placed on opposite sides of the upper and lower connectors and slid therebetween;

a master cylinder having a piston with one side of the piston in fluid communication with a fluid coupling located at a top end of the master cylinder and another side of the piston connected to a shaft which extends towards and out of a bottom end of the master cylinder; and tube means for connecting the fluid coupling end of the master cylinder to the fluid coupling ends of the left and right slave cylinders whereby an operator may depress the shaft of the master cylinder to extend the shafts of the slave cylinders and cause them to press against the lower connector or a substrate on which the lower connector is mounted, and thereby separate the upper connector from the lower connector.

9. The tool of claim 8 wherein the left and right slave cylinder and the master cylinder are each comprised of a disposable syringe.

10. The tool of claim 9 wherein the left and right extractor tabs are comprised of a finger rest associated with the disposable syringe which comprises a respective one of the left and right slave cylinders.

11. The tool of claim 8 wherein the connecting means comprises:

left and right mounting blocks, the left and right slave cylinders being located between said support member and a corresponding mounting block; and left and right means for pulling said left and right mounting blocks towards said support member whereby said left and right slave cylinders are held tightly thereto.

12. The tool of claim 11 wherein each left and right pulling means comprise a pair of screws which threadedly connect said support member to a corresponding mounting block on either side of a corresponding slave cylinder and wherein the distance varying means comprises:

a slot located in said support member; and at least one of said pair of screws extending through said slot whereby said pair of screws may be loosened and the corresponding mounting block and slave cylinder may be positioned as desired.

13. A tool for separating an upper electronic connector from a lower electronic connector comprising:

an elongated support member having a left end and a right end;

a left and a right syringe, each syringe having a piston with one side of the piston in fluid communication with a fluid coupling located at a top end of the syringe and another side of the piston connected to a shaft which extends towards and out of a bottom end of the syringe, each syringe having a finger tab extending perpendicularly away from the syringe at the bottom end thereof;

means for connecting said left and right syringes to corresponding ends of said support member such that the corresponding finger tabs are pointing towards one another;

means for varying a distance between the left and right syringes cylinders whereby said finger tabs may be placed on opposite sides of the upper and lower connectors and slid therebetween;

a master syringe having a piston with one side of the piston in fluid communication with a fluid coupling located at a top end of the master syringe and another side of the piston connected to a shaft which extends towards and out of a bottom end of the master syringe;

a T-connector having a first, second, and third fluid coupling;

first and second tubes connected between the first and second fluid couplings of the T-connector and respective ones of the fluid couplings of the first and second syringes;

a third tube connected between the third fluid coupling of the T-connector and the fluid coupling of the master syringe; and a fluid operatively connecting said master syringe to said first and second slave syringes through said first, second and third tubes and said T-connector, whereby an operator may depress the shaft of the master syringe to extend the shafts of the first and second syringes to press them against the lower connector or a substrate on which the lower connector is mounted, and thereby separate the upper connector from the lower connector.

14. A tool for separating an upper electronic connector from a lower electronic connector comprising:

a support member;

first and second extractor tabs connected to opposites sides of said support member and extending inward toward one another whereby said extractor tabs may be placed between the upper and lower connectors;

first and second operative shafts connected to opposite sides of said support member adjacent to said extractor tabs, each operative shaft extending downward toward the lower connector;

third and fourth extractor tabs mounted respectively at a distal end of the first and second operative shafts and extending inward towards one another, whereby the third and fourth extractor tabs may be placed between the upper and lower connectors along with the first and second extractor tabs; and means for moving said operative shafts from an upper position to a lower position whereby the operative shafts press against the lower connector hanging in free space or a substrate on which the lower connector is mounted, causing the extractor tabs to move upward, and thereby separating the upper connector from the lower connector.

* * * * *